United States Patent [19]

Jennings, Jr.

[11] Patent Number: 4,979,565

[45] Date of Patent: Dec. 25, 1990

[54] METHOD TO IMPROVE WELL PERFORMANCE IN GRAVEL PACKED WELLS

[75] Inventor: Alfred R. Jennings, Jr., Plano, Tex.

[73] Assignee: Mobil Oil Corporation, Fairfax, Va.

[21] Appl. No.: 443,689

[22] Filed: Nov. 30, 1989

[51] Int. Cl.[5] ..... E21B 43/04

[52] U.S. Cl. ..... 166/278; 166/276; 166/280; 166/305.1

[58] Field of Search ..... 166/265, 266, 276, 278, 166/279, 280, 305.1

[56] References Cited

U.S. PATENT DOCUMENTS

| | | | |
|---|---|---|---|
| 2,693,854 | 11/1954 | Abendroth | 166/278 |
| 2,952,318 | 9/1960 | Ritch | 166/280 |
| 2,978,024 | 4/1961 | Davis | 166/280 |
| 3,075,581 | 1/1963 | Kern | 166/278 |
| 3,434,540 | 3/1969 | Stein | 166/278 |
| 3,708,013 | 1/1973 | Dismukes | 166/276 |
| 3,756,318 | 9/1973 | Stein et al. | 166/278 |
| 3,983,941 | 10/1976 | Fitch | 166/276 |
| 4,334,540 | 6/1982 | Preti et al. | 128/630 |
| 4,378,845 | 4/1983 | Medlin et al. | 166/297 |
| 4,817,717 | 4/1989 | Jennings, Jr. et al. | 166/278 |

FOREIGN PATENT DOCUMENTS

| | | | |
|---|---|---|---|
| 519958 | 12/1955 | Canada | 166/276 |

*Primary Examiner*—Ramon S. Britts
*Assistant Examiner*—Roger J. Schoeppel
*Attorney, Agent, or Firm*—Alexander J. McKillop; Charles J. Speciale; Charles A. Malone

[57] ABSTRACT

A method to improve well performance in gravel packed wells. In this method a wellbore is perforated with four to twelve shots per foot. Thereafter, hydraulic fracturing is conducted in the formation via a viscous fracturing fluid, having a 20/40 mesh proppant therein, which creates and props a fracture. Hydraulic fracturing is ceased and a gravel pack is placed in the wellbore. The gravel pack contains gravel of a mesh smaller than the fracturing fluid proppant, e.g. 40/60 mesh. The larger mesh proppant in the fracture forms a screen which prevents entry of most fines or sand into the fracture while the smaller mesh proppant removes fines or sand escaping the fracture screen. Therefore, this combination removes substantially all fines or sand from hydrocarbonaceous fluids produced to the surface.

15 Claims, 1 Drawing Sheet

METHOD TO IMPROVE WELL PERFORMANCE IN GRAVEL PACKED WELLS

FIELD OF THE INVENTION

This invention relates to a method of completing a well that penetrates a subterranean formation and more particularly, relates to a well completion technique for controlling the production of sand from a formation.

Background of the Invention

In the completion of wells drilled into the earth, a string of casing is normally run into the well and a cement slurry is flowed into the annulus between the casing string and the wall of the well. The cement slurry is allowed to set and form a cement sheath which bonds the string of casing to the wall of the well. Perforations are provided through the casing and cement sheath adjacent the subsurface formation.

Fluids, such as oil or gas, are produced through these perforations into the well. These produced fluids may carry entrained therein sand, particularly when the subsurface formation is an unconsolidated formation. Produced sand is undesirable for many reasons. It is abrasive to components found within the well, such as tubing, pumps and valves, and must be removed from the produced fluids at the surface. Further, the produced sand may partially or completely clog the well, substantially inhibiting production, thereby making necessary an expensive workover. In addition, sand flowing from the subsurface formation may leave therein a cavity which may result in caving of the formation and collapse of the casing.

In order to limit sand production, various techniques have been employed for preventing formation sands from entering the production stream. One such technique, commonly termed "gravel packing", involves the forming of a gravel pack in the well adjacent the entire portion of the formation exposed to the well to form a gravel filter. In a cased perforated well, the gravel may be placed inside the casing adjacent the perforations to form an inside-the-casing gravel pack or may be placed outside the casing and adjacent the formation or may be placed both inside and outside the casing. Various such conventional gravel packing techniques are described in U.S. Pat. Nos. 3,434,540; 3,708,013; 3,756,318; and 3,983,941. These patents are incorporated by reference herein. Such conventional gravel packing techniques have generally been successful in controlling the flow of sand from the formation into the well.

In U.S. Pat. No. 4,378,845, there is disclosed a special hydraulic fracturing technique which incorporates the gravel packing sand into the fracturing fluid. This patent is incorporated by reference herein. Normal hydraulic fracturing techniques include injecting a fracturing fluid ("frac fluid") under pressure into the surrounding formation, permitting the well to remain shut in long enough to allow decomposition or "break-back" of the cross-linked gel of the fracturing fluid, and removing the fracturing fluid to thereby stimulate production from the well. Such a fracturing method is effective at placing well sorted sand in vertically oriented fractures. The preferred sand for use in the fracturing fluid is the same sand which would have been selected, as described above, for constructing a gravel pack in the subject pay zone in accordance with prior art techniques. Normally, 20–40 mesh sand will be used; however, depending upon the nature of the particular formation to be subjected to the present treatment, 40–60 or 12–20 mesh sand may be used in the fracturing fluid.

Use of either a gravel pack or a hydraulic fracturing technique with a proppant therein generally provides for sand control as well as removing a desired amount of hydrocarbonaceous fluids from a reservoir. Sometimes too much sand is produced so as to reduce the flow of hydrocarbonaceous fluids into said reservoir. This necessitates additional fracturing, cleaning or removing the gravel pack. Also, when fracturing with a sand proppant, sometimes sand does not fill each perforation which allows sand to enter the well.

Fracturing through deviated wells can produce a fracture which follows the wellbore perforations and then curves away which prevents a sand proppant from entering the perforation. Since the sand proppant has not entered some perforations, formation sand will not be prevented from entering the well with other hydrocarbonaceous fluids.

Therefore, what is needed is a method which will assure removal of formation sand from hydrocarbonaceous fluids while producing said fluids in a desired quantity.

SUMMARY OF THE INVENTION

This invention is directed to a method for improving the effectiveness of a gravel pack within an unconsolidated or loosely consolidated hydrocarbonaceous fluid containing formation or reservoir. In the practice of this invention, a wellbore is perforated in a manner sufficient to create a hydraulic fracture of the size and length sufficient to produce hydrocarbonaceous fluids from a formation. The wellbore is then hydraulically fractured with a viscous fracturing fluid which has a proppant therein sufficient to prop said formation while preventing the entry of formation fines into the wellbore. Thereafter, the wellbore is gravel packed so as to form a screen with the gravel therein. The gravel is of a size sufficient to exclude formation fines. The gravel is also of a size smaller than that used to prop the created fracture. Plugging of the gravel pack is thus minimized due to a larger proppant being used in the fracture. Utilization of this method creates a high conductivity fracture which allows substantially more drainage of the formation and a sustained production of hydrocarbonaceous fluids with enhanced removal of formation fines from said fluids.

It is therefore an object of this invention to provide for a better gravel screen in the formation by the utilization of a proppant of a size larger than the size of the gravel used in a gravel pack.

It is another object of this invention to use a proppant in the fracture which is of a size greater than the proppant used in the gravel pack so as to make the fracture be less acceptable to plugging than if a smaller size proppant is used.

It is yet another object of this invention to gravel pack a wellbore in a manner which will insure formation fines control and also provide for enhanced productivity of hydrocarbonaceous fluids because of the presence of a high conductivity fracture.

It is a yet further object of this invention to provide for a high conductivity fracture which allows substantially more drainage and sustained production of hydrocarbonaceous fluids with enhanced removal of formation fines from said fluids.

It is an even yet further object of this invention to keep formation fines out in the formation so as to avoid plugging the gravel pack and thereby reduce the cleaning and removal of said gravel pack.

It is a still yet even further object of this invention to minimize formation damage by reducing the amount of fines removed from the formation and produced to the surface.

It is an even still yet further object of this invention to provide for a more efficient gravel packing of a deviated wellbore so as to minimize the intrusion of fines into perforations around a deviated wellbore.

DESCRIPTION OF THE PREFERRED EMBODIMENTS

Figure 1:
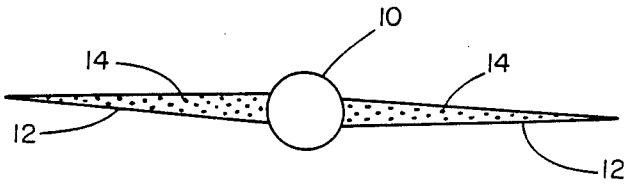
FIG. 1 is a plane view of a vertical fracture in an unconsolidated or loosely consolidated formation which is propped with a proppant of a size larger than that contained in a gravel pack.

In the practice of this invention, as is shown in FIG. 1, a hydraulic fracturing process is conducted in wellbore 10 so as to form a hydraulic fracture 12. This hydraulic fracture is formed by a viscous fracturing fluid which contains a proppant 14 therein. In order to obtain the desired fracture, wellbore 10 is perforated with 4 to 12 shots per foot. The wellbore can either be cased or uncased, i.e. an "open hole". The proppant which is utilized should be about 20/40 US Sieve or larger depending upon the nature of the formation and the enhanced oil recovery method desired to be employed. The proppant can be a conventional proppant or a fused refractory proppant, e.g., silicon carbide or silicon nitride. A sand control method wherein a special hydraulic fracturing technique is utilized is disclosed by Medlin et al. in U.S. Pat. No. 4,378,845 which issued on Apr. 5, 1983. A method for hydraulic fracturing wherein a refractory proppant was used for sand control is taught by Jennings, Jr. et al. in U.S. Pat. No. 4,817,717 which issued on Apr. 4, 1989. Both patents are hereby incorporated by reference herein. As is mentioned in U.S. Pat. No. 4,378,845, the "frac fluid" may comprise a gel. Other viscous fracturing fluids can also be utilized.

Hydraulic fracturing with the viscous frac fluid and proppant therein causes the proppant to be forced up against the fracture face. In this manner, the proppant serves to hold back sand or fines from the unconsolidated or loosely consolidated formation. Holding back the sand or fines in this manner causes a filter screen to be formed around the fracture face and also within the fracture itself so as to retard a movement of fines or sand from the formation into wellbore 10. Propping the fracture in this manner also causes the fracture to have high conductivity which allows more drainage and sustained production of hydrocarbonaceous fluids from the formation. Additionally, the large diameter proppant in the fracture makes the fracture less susceptible to plugging than would a smaller proppant.

Even though a screen is formed in the fracture and on the fracture's face, some sand or fines will enter the fracture and proceed toward wellbore 10. In order to prevent the intrusion of these sands or fines into the wellbore along with the hydrocarbonaceous fluids, an in-casing gravel pack is placed within wellbore 10. A method for forming an in-casing gravel pack is disclosed by Fitch in U.S. Pat. No. 3,983,941 which issued on Oct. 5, 1976. This patent is hereby incorporated herein by reference. The gravel pack contains a gravel therein of a size sufficient to remove fines or sands from the hydrocarbonaceous fluids which escape through the screen which is formed by the proppant in the fracture. Therefore, the gravel utilized should be of a size just smaller than the proppant which is used in the fracturing fluid to prop the fracture.

Figure 2:
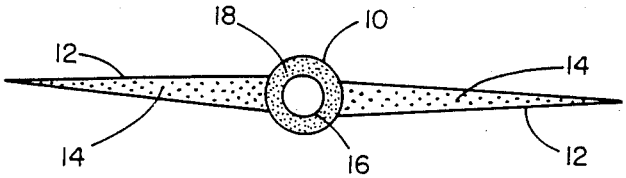
FIG. 2 is a plane view of a high conductivity propped fracture with an in-casing gravel pack wherein the gravel size of said pack is smaller than the proppant utilized in the fracture.

As is shown in FIG. 2, an in-casing gravel pack 16 is formed within wellbore 10. Gravel 18 which is used in the gravel pack is of a size of about 40/60 U.S. Sieve. Since most of the sands or fines will be captured in the screen formed by the larger proppant contained in the fracturing fluid, gravel 18 contained in gravel pack 16 being smaller in size will remove any fines or sands which escape through the screen formed in the fracture. Thus, the screen formed in the fracture in combination with the smaller screen formed by the gravel pack will substantially remove most of the fines or sands from hydrocarbonaceous fluids entering the wellbore.

Since most of the fines or sands are removed by the proppant utilized in the fracture, gravel pack 16 would be less susceptible to plugging because of the smaller volume of sands or fines which will reach gravel pack 16. Thus, the gravel pack helps insure formation fines control. Additionally the gravel pack in combination with the screen formed in the fracture enhances the production of hydrocarbonaceous fluids that results from the presence of the high conductivity fracture which was previously formed.

Obviously, many other variations and modifications of this invention as previously set forth may be made without departing from the spirit and scope of this invention as those skilled in the art readily understand. Such variations and modifications are considered part of this invention and within the purview and scope of the appended claims.

What is claimed is:

1. A method for improving the effectiveness of a gravel pack within an unconsolidated or loosely consolidated hydrocarbonaceous fluid containing formation or reservoir comprising:

(a) perforating a wellbore in a manner sufficient to create a hydraulic fracture of a size and length sufficient to produce hydrocarbonaceous fluids from said formation;

(b) fracturing hydraulically said formation with a viscous fracturing fluid having a proppant therein sufficient to prop said fracture while also preventing the entry of most formation fines into said wellbore because a filter screen its formed around the fracture face and within the fracture which retards fines movement from said formation; and (c) thereafter gravel packing the wellbore so as to form a smaller screen than in step (b) with gravel therein of a size sufficient to exclude formation fines that have escaped from the propped fracture which gravel is smaller than that used to prop the created fracture thereby minimizing pack plugging and removing substantially all fines from fluids entering the wellbore.

2. The method as recited in claim 1 where said wellbore is perforated with four to twelve shots per foot.

3. The method as recited in claim 1 where a high conductivity fracture is formed which allows substantially more drainage and sustained productivity with enhanced removal of formation fines.

4. The method as recited in claim 1 where the proppant contained in said fracturing fluid is about 40 U.S. Sieve size or larger and the gravel in said pack is about 40 U.S. Sieve size or smaller.

5. The method as recited in claim 1 where said wellbore is cased or uncased.

6. A method for improving the effectiveness of a gravel pack within an unconsolidated or loosely consolidated hydrocarbonaceous fluid containing formation or reservoir comprising:

(a) perforating a wellbore in a manner sufficient to create a hydraulic fracture of a size and length sufficient to produce hydrocarbonaceous fluids from said formation;

(b) fracturing hydraulically said formation with a viscous fracturing fluid having a proppant therein sufficient to prop said fracture while also preventing the entry of most formation fines into said wellbore because a filter screen is formed around the fracture face and within the fracture which retards fines movement from said formation;

(c) thereafter gravel packing the wellbore so as to form a smaller screen than in step (b) with gravel therein of a size sufficient to exclude formation fines that have escaped from the propped fracture which gravel is smaller than the proppant used to prop the created fracture thereby minimizing pack plugging due to fines removal by the screen formed by the larger proppant in the fracture; and (d) producing substantially fines or sand free hydrocarbonaceous fluids from said formation in an increased volume because of the combined effect of fines removal by the screens formed in the fracture and the gravel pack.

7. The method as recited in claim 6 where said wellbore is perforated with four to twelve shots per foot.

8. The method as recited in claim 6 where a high conductivity fracture is formed.

9. The method as recited in claim 6 where the proppant contained in said fracturing fluid is about 40 U.S. Sieve size or larger and the gravel in said pack is about 40 U.S. Sieve size or smaller.

10. The method as recited in claim 6 where said wellbore is cased or uncased.

11. A method for improving the effectiveness of fines or sand removal within an unconsolidated or loosely consolidated formation or reservoir comprising:

(a) perforating a wellbore in a manner sufficient to create a hydraulic fracture of a size sufficient to produce a desired fluid from said formation;

(b) fracturing hydraulically said formation with a viscous fluid having a silicon carbide or silicon nitride proppant therein sufficient to prop said fracture while also preventing entry of most formation fines into said wellbore because a filter screen is formed around the fracture face and within the fracture which retards fines movement from said formation; and (c) thereafter gravel packing the wellbore so as to form a smaller screen than in step (b) with gravel therein of a size sufficient to exclude formation fines that have escaped from the propped fracture which gravel is smaller than the proppant used to prop the created fracture thereby minimizing pack plugging due to fines removal by the screen formed by the larger proppant in the fracture.

12. The method as recited in claim 11 where said wellbore is perforated with four to twelve shots per foot.

13. The method as recited in claim 11 where a high conductivity fracture is formed.

14. The method as recited in claim 11 where the proppant contained in said fracturing fluid is about 40 U.S. Sieve size or larger and the gravel in said pack is about 40 U.S. Sieve size or smaller.

15. The method as recited in claim 11 where said wellbore is cased or uncased.

* * * * *